US006219002B1

(12) United States Patent
Lim

(10) Patent No.: US 6,219,002 B1
(45) Date of Patent: Apr. 17, 2001

(54) PLANAR ANTENNA

(75) Inventor: Kyu-tae Lim, Kyungki-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/256,319

(22) Filed: Feb. 24, 1999

(30) Foreign Application Priority Data

| | | |
|---|---|---|
| Feb. 28, 1998 | (KR) | 98-6608 |
| May 6, 1998 | (KR) | 98-16135 |
| May 6, 1998 | (KR) | 98-16136 |

(51) Int. Cl.[7] ..... H01Q 13/12

(52) U.S. Cl. ..... 343/769; 343/700 MS; 343/767

(58) Field of Search ..... 343/700 MS, 767, 343/768, 769, 846; H01Q 1/38, 21/24, 21/26, 13/12

(56) References Cited

U.S. PATENT DOCUMENTS

| | | | | |
|---|---|---|---|---|
| 4,320,402 | | 3/1982 | Bowen . | |
| 4,547,779 | * | 10/1985 | Sanford et al. | 343/700 MS |
| 4,623,893 | | 11/1986 | Sabban . | |
| 4,719,470 | * | 1/1988 | Munson | 343/700 MS |
| 4,816,835 | * | 3/1989 | Abiko et al. | 343/700 MS |
| 4,973,972 | * | 11/1990 | Huang | 343/700 MS |
| 5,181,042 | * | 1/1993 | Kaise et al. | 343/700 MS |
| 5,510,803 | * | 4/1996 | Ishizaka et al. | 343/700 MS |
| 5,714,961 | | 2/1998 | Kot et al. . | |
| 5,892,486 | | 4/1999 | Cook et al. . | |
| 5,892,487 | * | 4/1999 | Fujimoto et al. | 343/840 |

FOREIGN PATENT DOCUMENTS

| | | |
|---|---|---|
| 0064313A1 | 4/1982 | (EP) . |
| 0 355 898 | 2/1990 | (EP) . |
| 1 546 571 | 5/1979 | (GB) . |
| 2152757 | 8/1985 | (GB) . |
| 2187333 | 9/1987 | (GB) . |
| 2284936 | 6/1995 | (GB) . |
| 2065503 | 3/1990 | (JP) . |
| 5343915 | 12/1993 | (JP) . |
| WO 94/13029 | 6/1994 | (WO) . |

* cited by examiner

*Primary Examiner*—Don Wong
*Assistant Examiner*—Tho Phan
(74) *Attorney, Agent, or Firm*—Burns, Doane, Swecker & Mathis, L.L.P.

(57) ABSTRACT

A planar antenna is provided. The planar antenna includes a conductor plate for radiating radio waves to free space, an upper dielectric layer attached to the upper side of the conductor plate, a feeder unit attached to the upper surface of the upper dielectric layer for feeding current for the wave radiation of the conductor plate, and a plurality of dielectric layers attached to the lower side of the conductor plate and including at least one air layer. The planar antenna having the ring-slot radiation device according to the present invention has a very simple structure and occupies a small space since it has a planar structure and uses only one radiation device. It is possible to increase the efficiency and the gain of the antenna by using the multiple layer dielectric in which the air layer is inserted between the dielectric layers of the planar antenna. The planar antenna can be easily manufactured even in the millimetric-wave bandwidth. The planar antenna having the air layer using the columns can be easily manufactured since it is not necessary to join the entire surface of each dielectric. Also, the parasitic effect is reduced since the contact surface among the dielectrics are small.

17 Claims, 11 Drawing Sheets

FIG. 1
CONVENTIONAL
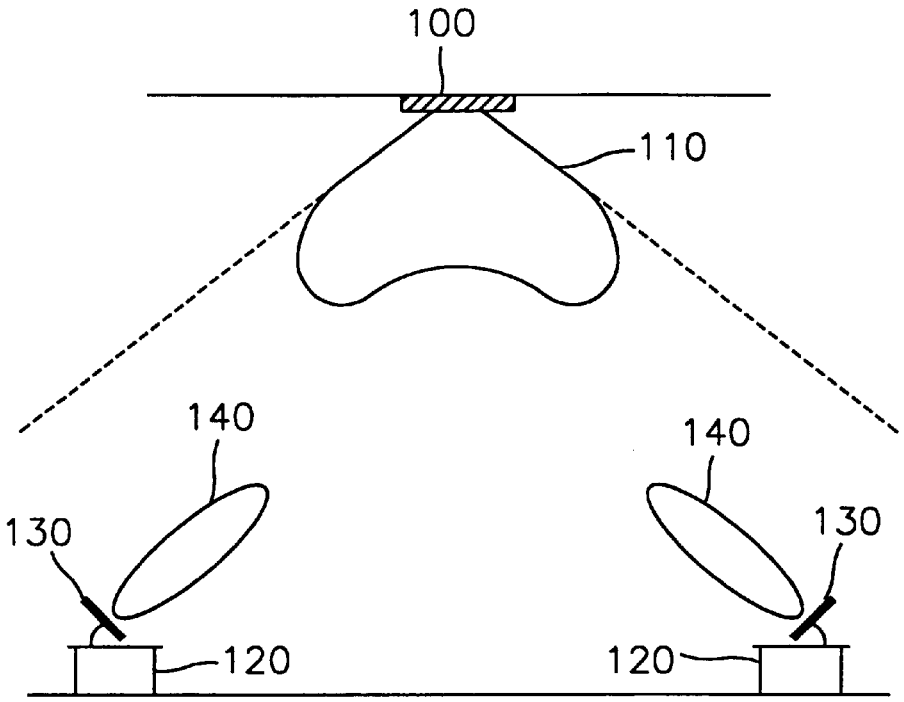
FIG. 2A
CONVENTIONAL
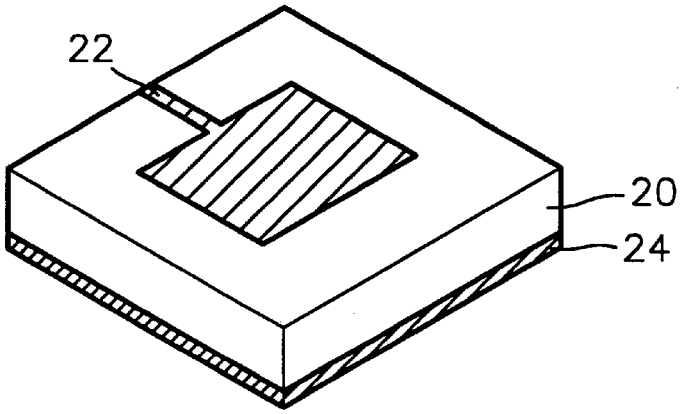

FIG. 2B
CONVENTIONAL
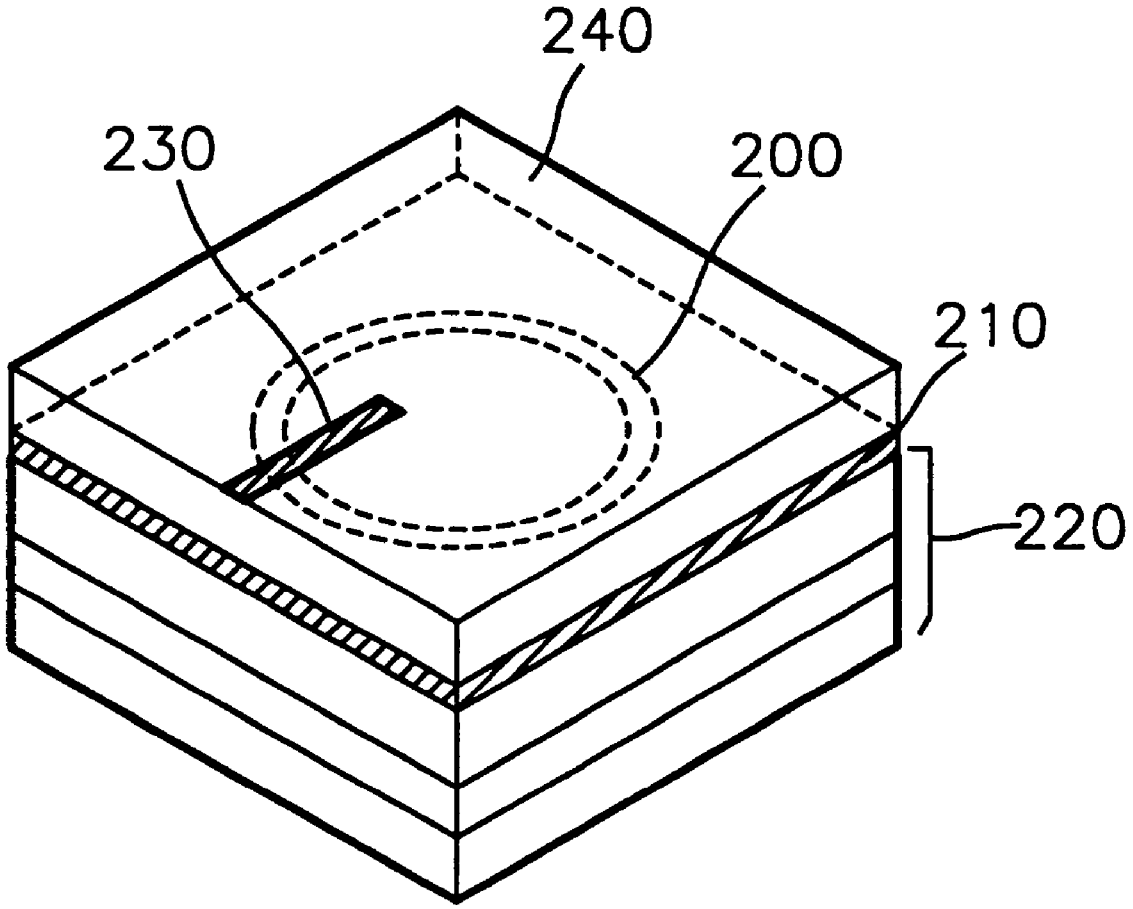

FIG. 3
CONVENTIONAL
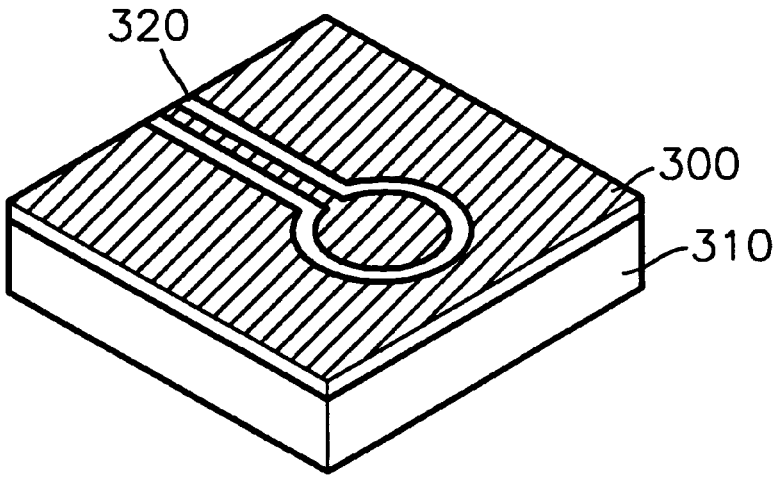

(a)

(b)

(a)

(b)

PLANAR ANTENNA

BACKGROUND OF THE INVENTION

1. Field of the Invention

The present invention relates to antenna, and more particularly, to a planar antenna.

2. Description of the Related Art

In general, an antenna is a special electric circuit used in connection with a high frequency circuit. A transmitting antenna efficiently converts the electric power of the high frequency circuit into wave energy and radiates the converted wave energy into free space. A receiving antenna efficiently converts the energy of an input wave into electric power and transmits it to the electric circuit. The antenna operates as an energy converter between the electric circuit wave and the radio wave. The size and shape of the antenna is appropriately designed so as to improve conversion efficiency.

The beam pattern of the antenna is important in determining the channel characteristic in a high speed radio communication system. FIG. 1 shows the beam pattern of an antenna provided for indoor high speed mobile radio communication. A base antenna 100 on a ceiling has a wide beam width 110. An antenna 130 attached to a user terminal 120 has a directional beam characteristic 140. Antennas for indoor high speed mobile communication use circular polarization in order to reduce the occurrence of a multipath fading phenomenon.

An antenna having the directional beam characteristic required for a receiving-end antenna can be easily realized using an array antenna. However, it is very difficult to realize a circularly polarized antenna having a wide beam angle such as that required for a base antenna. If a base antenna radiation pattern has a bowl shaped beam characteristic in which the antenna gain in the middle is low, the strength of the received electric field is uniform regardless of the position of a user. Therefore, it is possible to remarkably relax restrictions on the linear characteristics of RF transmitting and receiving ends, to easily realize an RF system, and considerably reduce manufacturing expenses.

In general, the planar antenna comprised of a dielectric and a conductor induces current to the surface of a conductor put on the dielectric or a slot and radiates electromagnetic wave energy into free space. The planar antenna occupies a small space since it can be attached to the surface of a terminal or a wall. It is possible to easily construct the array antenna using the planar antenna. Also, the manufacturing price of the planar antenna is low since it can be mass-produced. However, an undesired surface wave mode is generated other than a radiation mode since a dielectric layer is used. Accordingly, the efficiency of planar antenna is low. In the planar antenna, the wave is radiated into free space when current flows on the surface of the conductor and there exists a surface wave proceeding along the surface of the dielectric. The number of surface wave modes is proportional to the thickness of the dielectric layer. A minimum of one surface wave modes exists. The thickness of the dielectric layer should be reduced in order to suppress the number of surface wave modes. Only one mode (which cannot be removed) is generated when the thickness is reduced to no more than ¼ of the radio wavelength in the dielectric. Accordingly, loss is minimized. In practice, however, since the wavelength is several mms in a millimetric wave bandwidth, the dielectric layer is so thin that it can be easily broken when it is manufactured.

FIG. 2A shows a micro-strip patch antenna which is widely used as a planar antenna. The micro-strip patch antenna is comprised of dielectric 20, a conductor 24 located under the dielectric 20, and a micro strip line 22 for feeding the current. FIG. 2B shows an example of a planar antenna using a multiple dielectric layer, which is comprised of the multiple dielectric layer 220, a conductor plate 210 positioned on the multiple dielectric layer including a ring slot 200, dielectric 240 positioned on the conductor plate 210, and a feeder unit 230 for feeding current to the ring slot 200.

In general, in the case of obtaining a circular polarization characteristic using the micro-strip patch antenna, it is very difficult to obtain an excellent axial ratio with respect to a wide angle. Also, the cross polarization characteristic is not good. Also, when the frequency is no less than the millimetric wave bandwidth, the planar antenna becomes so small that the dielectric is difficult to make and is easily broken by a slight shock.

A planar antenna formed by stacking various layers of dielectric having a thickness of ¼ wavelength was once provided in order to make a thick and efficient planar antenna. In such a planar antenna, it is possible to increase the gain when the dielectric layers are stacked in an order in which the dielectric constants of the respective layers are high-low-high. However, it is not easy to make a multiple dielectric layer for a high millimetric wave bandwidth. That is because parasitic effects generated on the contact surface of different materials deteriorate the performance of the antenna when the antenna is not very precisely manufactured. Also, the performance may be affected if the antenna is twisted due to a change in temperature or compression.

It is possible to increase the gain by attaching an oval dielectric lens in the high millimetric wave bandwidth. However, the method is used in an extremely specialized field such as radio astronomy due to large expenses for precisely processing the lens and technological difficulties.

FIG. 3 shows a ring-slot antenna, which comprises a conductor plate 300, dielectric 310 under the conductor plate 300, and a slot 320 for radiating the radio wave. The ring-slot antenna is a uniplanar radiation device which replaces the micro-strip antenna in a millimetric wave frequency bandwidth. It can be easily manufactured even for a high frequency. The ring-slot antenna can employ various feeding methods such as a micro strip transmission line and a coplanar waveguide (CPW). It is possible to easily realize an antenna having a dual polarization characteristic with the ring-slot antenna. However, it is not easy to obtain the circular polarization characteristic at a wide angle though the above antenna is used. Since a ground surface exists on the same surface as the antenna, undesired backward radiation often occurs. A method of feeding to the ring-slot from two points with an angle difference of 90° is used for realizing the dual polarization. In this case, the beam pattern is directional and asymmetrical. Also, it is difficult to obtain a desired axial ratio characteristic.

SUMMARY OF THE INVENTION

It is an object of the present invention to provide a planar antenna by which it is possible to obtain a bowl shaped beam characteristic and to obtain a circular polarization characteristic having a wide angle by feeding current to four micro strip transmission lines and using a ring-slot as a radiation device.

It is another object of the present invention to provide a planar antenna using multiple dielectric layers into which an air layer having a small dielectric constant has been inserted in order to increase the antenna gain.

Accordingly, to achieve the above objects, there is provided a planar antenna comprising a conductor plate for radiating radio waves to free space, an upper dielectric layer attached to the upper side of the conductor plate, a feeder unit attached to the upper surface of the upper dielectric layer for feeding current for the wave radiation of the conductor plate, and a plurality of dielectric layers attached to the lower side of the conductor plate and including at least one air layer.

The lower dielectric layer has a higher dielectric constant than the upper dielectric layer.

The air layer preferably has a dielectric constant equal to or less than that of the upper and lower dielectric layers of the air layer. The air layer can be formed by inserting columns between two dielectric layers constructing the plurality of lower dielectric layers. The thickness of the air layer is preferably ¼ of the wavelength of the radio wave passing through the air layer and the thickness of the two dielectric layers into which the air layer is inserted is preferably ¼ of the wavelength in the dielectric.

The air layer is preferably formed by inserting a honeycomb layer between two dielectric layers constructing the plurality of lower dielectric layers. The thickness of the honeycomb layer is preferably ¼ of the wavelength of the radio wave passing through the honeycomb layer and the thickness of the two dielectric layers into which the honey comb layer is inserted is preferably ¼ of the wavelength in the dielectric.

The planar antenna according to the present invention comprises a conductor plate including a ring-slot radiation device formed by boring a ring-shaped hole in the conductor for radiating radio waves through the ring-slot radiation device, an upper dielectric layer attached to the upper side of the conductor plate and formed of dielectric, a feeder unit attached to the upper surface of the upper dielectric layer for feeding current for the wave radiation of the conductor plate, and a lower dielectric layer attached to the lower side of the conductor plate and formed of dielectric. The feeder unit has four micro-strip transmission lines for feeding current, the four feeding points are positioned at 0°, 45°, 180°, and 225° on the basis of the central line of the ring-slot radiation device, and the phases of the feeder signal fed through the respective micro strip lines are set to 0°, 90°, 0°, and 90° by controlling the lengths of the micro-strip lines.

The positions of the four feeding points of the micro strip transmission line feeder unit can be positioned at 0°, −45°, 180°, and 135° on the basis of the central line of the ring-slot radiator.

The lower dielectric layer preferably has a dielectric constant higher than that of the upper dielectric layer. The lower dielectric layer is comprised of a plurality of dielectric layers. The plurality of dielectric layers are multiple dielectric layers including a honeycomb layer.

The dielectric layer is preferably formed to have a thickness of $$\frac{\lambda_d}{4}$$

($\lambda_d$: the wavelength of the radio wave radiated, passing through dielectric) and is preferably formed so that the difference between dielectric constants of adjacent dielectric layers is larger than a predetermined value. The lower dielectric can be a dielectric lens.

The circumference of the ring-slot radiation device of the conductor plate is defined to form a resonance mode of at least second degree.

The planar antenna according to the present invention comprises a conductor plate including a ring-slot radiation device formed by boring a ring-shaped hole in the conductor for radiating radio waves through the ring-slot radiation device, an upper dielectric layer attached to the upper side of the conductor plate and formed of dielectric, a feeder unit attached to the upper surface of the upper dielectric layer for feeding current for feeding current for the wave radiation of the conductor plate, and a lower dielectric layer attached to the lower side of the conductor plate and formed of a plurality dielectric layers including an air layer. Here, the feeder unit has four micro-strip transmission lines for feeding current, the four feeding points are positioned at 0°, 45°, 180°, and 225° on the basis of the central line of the ring-slot radiation device, and the phases of the feeder signal fed through the respective micro strip lines are 0°, 90°, 0°, and 90° by controlling the lengths of the micro strip lines.

BRIEF DESCRIPTION OF THE DRAWINGS

The above objects and advantages of the present invention will become more apparent by describing in detail a preferred embodiment thereof with reference to the attached drawings in which:

FIG. 1 shows the beam pattern of an antenna provided for an indoor high speed mobile communication;

FIG. 2A shows a micro strip patch antenna widely used as a planar antenna;

FIG. 2B shows an example of a planar antenna using a multiple dielectric layer;

FIG. 3 shows a ring-slot antenna;

DESCRIPTION OF THE PREFERRED EMBODIMENTS

Figure 4:
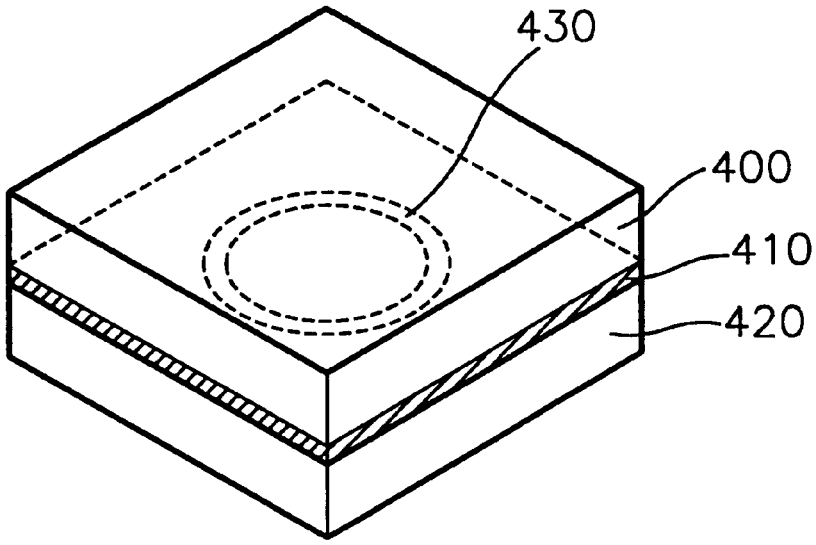
FIG. 4 shows the structure of a radiator for a ring-slot antenna according to the present invention.

Hereinafter, the present invention will be described in detail with reference to the attached drawings. FIG. 4 shows the structure of a planar antenna having a ring-slot radiator according to the present invention. The planar antenna has a multi layer planar structure. An upper dielectric layer 400, a conductor plate 410, and a lower dielectric layer 420 are stacked from the top down. A ring-slot device 430 formed by boring a ring shaped hole in the conductor plate 410 operates as an antenna. The ring-slot device 430 is designed so that the electromagnetic radiation in the forward direction is a bowl shaped beam and that a second resonance occurs at a given frequency.

To achieve this, the ring-slot device is designed so that the circumference of the ring-slot is 0.9 to 1.1 times the wavelength inside the slot. Since the width of the slot determines the input impedance of the slot, the slot is designed so that impedance matching with an antenna feeder unit is easily performed. Efficiency is increased since coupling with the feeder unit is well performed when the width of the slot is widened. However, the beam pattern is distorted since a higher mode in a radial direction is generated when the width of the slot is too wide. Therefore, the width of the slot is appropriately determined.

Figure 5:
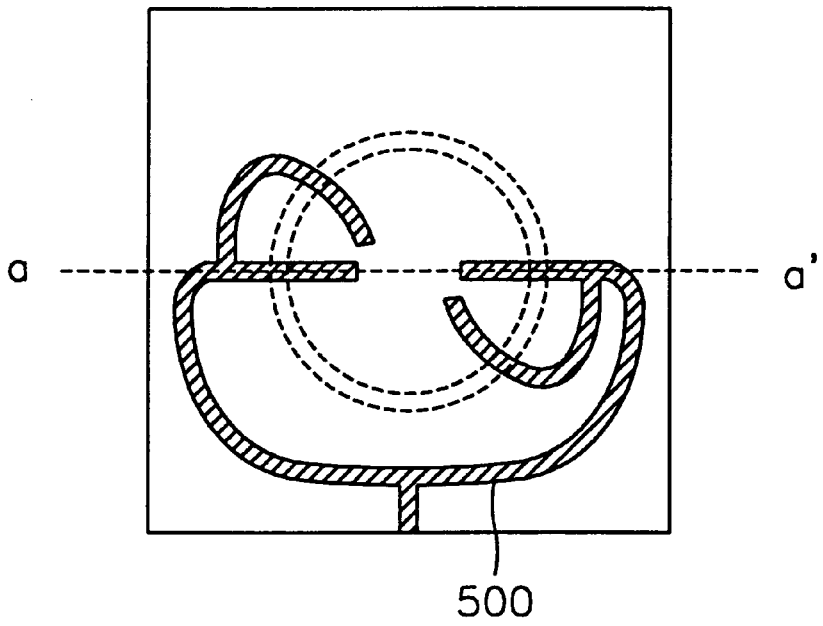
FIG. 5 shows a micro-strip feeder unit illustrated as a conductor strip attached to the surface of an upper dielectric layer, on the upper side of a conductor plate, and connecting the conductor plate to an RF circuit.

FIG. 5 shows a micro strip feeder unit 500 for connecting the upper dielectric layer 400 to the RF circuit, as a conductor strip attached to the surface of the upper dielectric layer 400 on the upper side of the conductor plate 410. The antenna feeder 500 is symmetrical. Current is fed at four points so that a circular polarization characteristic can be obtained in a wide angle. For this case, a feeder is designed so that feeding points are 0°, 45°, 180°, and 225° (or 0°, −45°, 180°, and 135°) on the basis of a central line a–a' of the ring-slot radiation device and that the phases of feeder current are 0°, 90°, 0°, and 90° with respect to the circularly consecutive feeding points. To achieve this, the current is uniformly transmitted to four places through a power divider from one feeder micro strip transmission line connected to RF transmitting and receiving ends. Also, the phase difference of the feeder electric field is controlled by controlling the lengths of the respective feeder transmission lines. Reflection loss is minimized by installing an impedance converter at each power divider. Also, the length and width of the feeder transmission lines are designed so that coupling between the strip and the slot is maximized.

The gain of the antenna is increased by attaching a single or multiple dielectric layer or an oval dielectric lens 510 to the lower side of the conductor plate 410. In this case, the dielectric constant of the lower side dielectric layer should be higher than the dielectric constant of the upper side dielectric layer. This is to increase the front/back ratio of the antenna radiation pattern.

In the case of the slot antenna, since much current is radiated to the side having a high dielectric constant, the dielectric layer having a high dielectric constant is attached to the lower side of the conductor plate. In this case, a surface wave proceeding along the dielectric surface is generated inside the dielectric on the other side of the wave radiated to free space. The thickness of the dielectric layer should be ¼ of the wavelength in order to suppress the generation of the surface wave.

Figure 6:
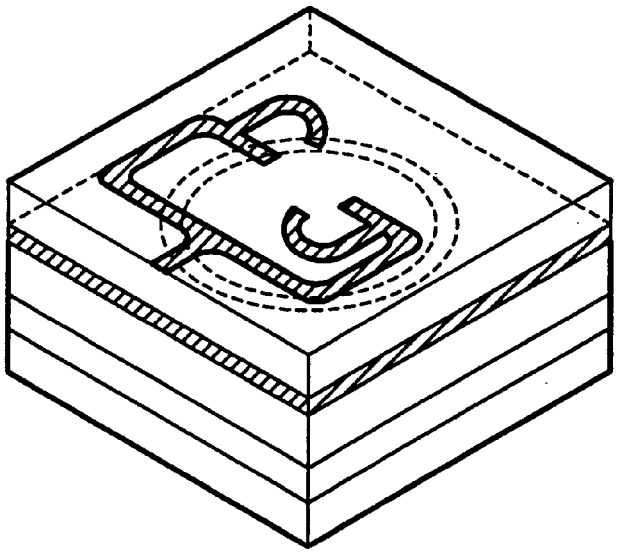
FIG. 6 shows the structure of a ring-slot antenna in which a multiple dielectric layer is attached to the lower side of the conductor plate instead of the lower dielectric layer.

FIG. 6 shows the structure of a ring slot antenna in which the multiple dielectric layer 610 is attached to the lower side of the conductor plate instead of the single lower dielectric layer. The thickness of the dielectric layer becomes too thin in a millimetric wave bandwidth since the wavelength is too small. Therefore, as shown in FIG. 6, various dielectric layers having the thickness of ¼ wavelength are stacked and attached to the lower side of the conductor plate. Accordingly, it is possible to prevent the efficiency from being lowered even though the thickness is increased. In this case, it is possible to increase the antenna gain by making the dielectric constants of the multiple dielectric layer high-low-high.

Figure 7:
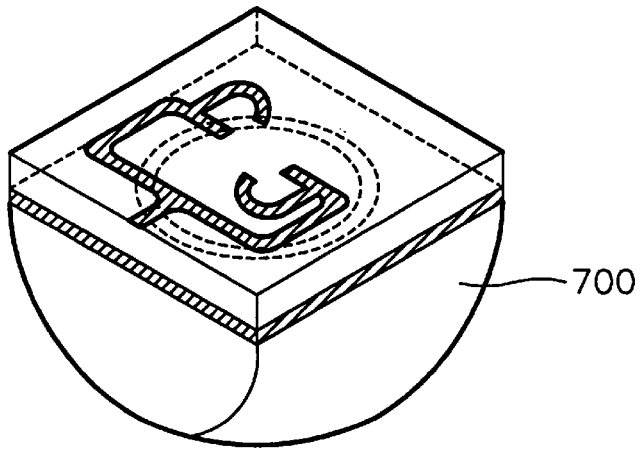
FIG. 7 shows the structure of a ring slot antenna in which the multiple dielectric layer and dielectric lens are attached to the lower side of the conductor plate instead of the lower dielectric layer.

FIG. 7 shows the structure of the ring-slot antenna in which the dielectric lens 700 is attached to the lower side of the conductor plate instead of the single lower dielectric layer. The dielectric lens 700 is attached to the lower side of the conductor plate in order to obtain a high gain beam characteristic.

The operation of the planar antenna having the ring-slot radiator according to the present invention will be described. A high frequency signal coupled from the feeder transmission line to the slot induces an electromagnetic field in the ring slot. The electromagnetic field induced in the slot operates as a magnetic current source and radiates an electromagnetic wave to free space. At the time when the circumference of the ring slot is 'n* times wavelength in the slot/2 (where n is an integer)', a resonance mode is formed. The radiation of the wave energy to free space is maximized. It is possible to construct various types of feeder circuits when the micro strip transmission line is used. The upper dielectric layer is formed of a material having a low dielectric constant in order to prevent to much electromagnetic wave radiation in the direction of the feeder circuit.

Figure 8:
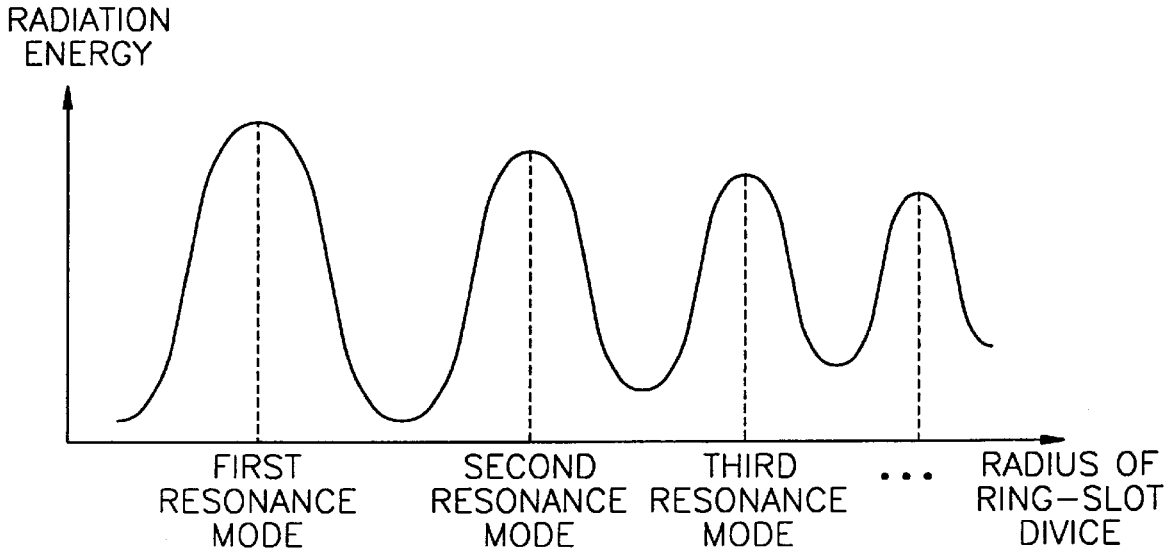
FIG. 8 shows the radiation energy (or radiation resistance) according to the radius of a ring slot device.

FIG. 8 shows the radiation energy (or the radiation resistance) according to the radius of the ring-slot device. In a resonance mode, the radiation energy is maximized by the relationship between the circumference of the ring slot device and the electric field waveform in the slot. In the first resonance mode, the beam has a directional characteristic. In the second resonance mode, namely, when n is 2, the beam is concave and has a 3 dB width of no less than 120°. Here, the characteristic of a left-hand or a right-hand circularly polarized wave is obtained by feeding current to four points (0°, 45°, 180°, and 225°) of the ring slot of the second resonance mode, having different phases of 0°, 90°, 0°, and 90°. It is also possible to obtain the characteristic of a circularly polarized wave by feeding current to the positions of 0°, −45°, 180°, and 135°.

The wave radiated from the slot is radiated to free space through the dielectric layer. More wave is radiated to the lower side of the conductor plate having a high dielectric constant.

Figure 9:
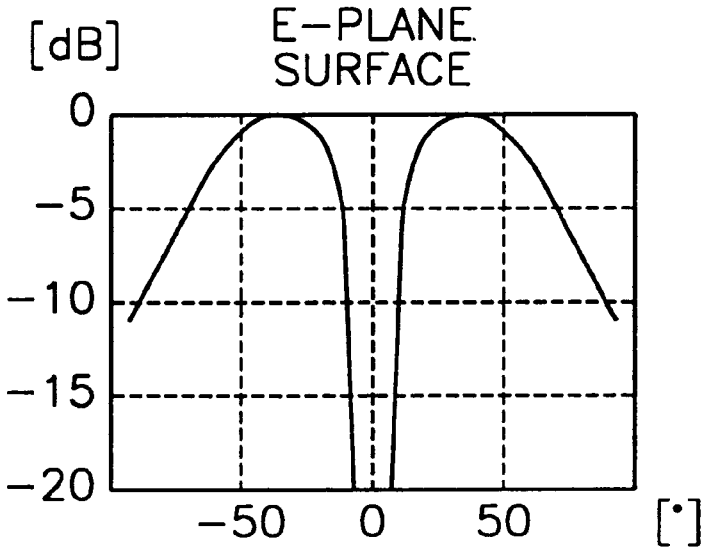
FIGS. 9A and 9B show the result of theoretically calculating the radiation characteristic of the ring-slot antenna according to the present invention.
Figure 9:
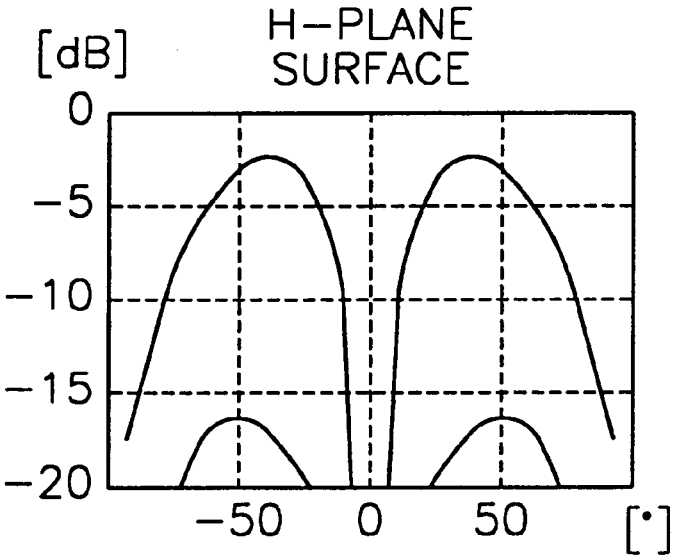
Figure 10:
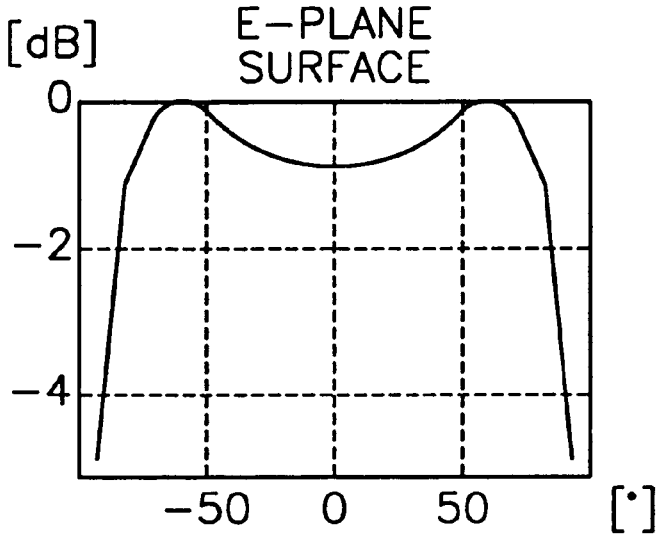
FIGS. 10A and 10B show the axial ratio which is used for examining a circular polarization characteristic.
Figure 10:
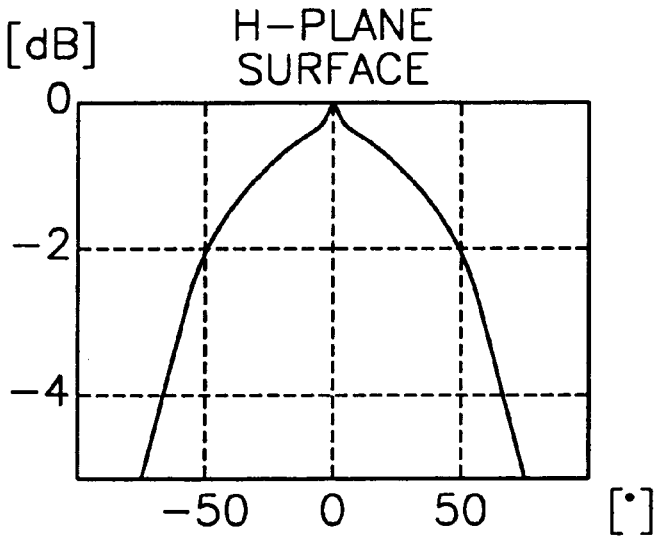

FIGS. 9A and 9B show a result of theoretically calculating the radiation characteristic of the planar antenna having the ring-slot radiator according to the present invention. A full-wave analysis method is used. It is noted that there is a null at 0° and the 3 dB beam width is over 120° in FIGS. 9A and 9B. FIGS. 10A and 10B show axial ratios for examining the characteristics of the circularly polarized wave. In the case of a complete circularly polarized wave, the maximum ratio between the vertical electromagnetic field and the horizontal electromagnetic field is 1 and the phase difference is 90°. As shown in FIGS. 10A and 10B, the characteristic of the circularly polarized wave is shown in a wide area (120°).

Figure 11:
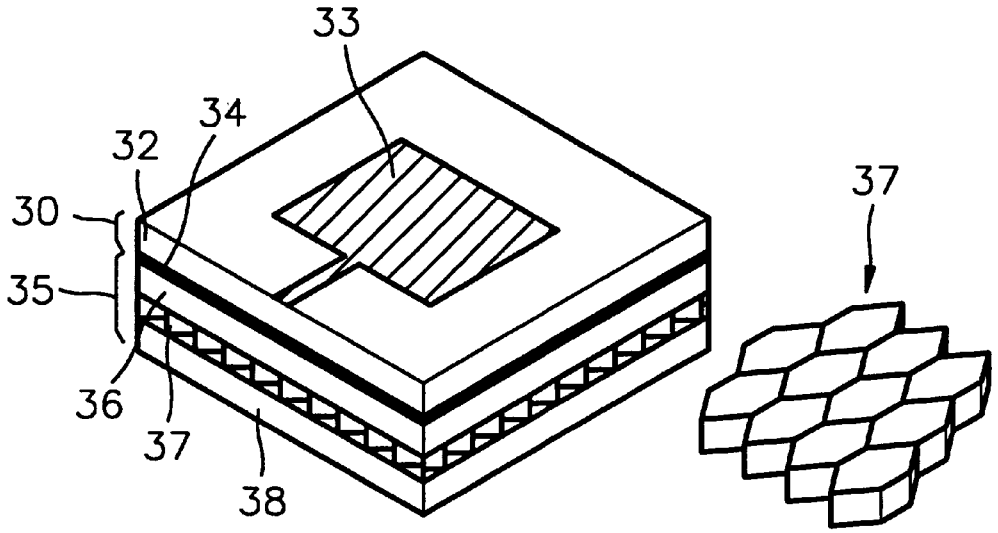
FIG. 11 shows the structure of a planar antenna using a multiple dielectric layer including a honeycomb layer according to the present invention.

FIG. 11 shows the structure of the planar antenna using the multiple dielectric layer including a honeycomb layer according to the present invention, which comprises a planar antenna 30 and a multiple dielectric layer 35.

The planar antenna layer 30 is comprised of a conductor plate 34 for radiating the radio wave to free space, an upper dielectric layer 32 attached to the upper side of the conductor plate 34, and a feeder unit 33 attached to the upper surface of the upper dielectric layer for feeding current for the wave radiation of the conductor plate. The feeder unit 33 is for a general planar antenna. The shape of the feeder unit 33 may be the same as that of the feeder of the micro-strip patch antenna or the ring-slot antenna. The planar antenna layer 30 induces the current to the surface of the conductor put on the upper dielectric layer 32 or the slot shaped feeder and radiates the electromagnetic wave energy to free space.

The multiple dielectric layer 35 is comprised of a multiple layer dielectric, including a honeycomb layer 37, attached to the radiation direction side of the planar antenna layer 30 and increases the gain of the antenna. The multiple layer dielectric 35 is comprised of a honey comb layer 37 formed of dielectric and having a hexagonal cell structure, a lower dielectric layer 38 attached to the lower portions of the honey comb layer 37 and formed of the dielectric having the high dielectric constant, and an upper dielectric layer 36 attached to the upper portions of the honeycomb layer 37 and formed of the dielectric having the high dielectric constant. After putting the honeycomb structure having a thickness of ¼ wavelength (the wavelength in the air) on the dielectric plate having the thickness of ¼ wavelength (the wavelength in the dielectric), the dielectric layer is put on the layer having the honeycomb structure. It is possible to realize the multiple layer dielectric having a desired number of layers by the above method.

In general, the honeycomb structure is used to prevent twisting due to external causes such as compression and temperature change, while attached to the surface of equipment. The multiple dielectric layer is constructed by stacking the honeycomb and the dielectric, and is applied to the planar antenna. The honeycomb layer 37 prevents the transformation of the shape of the antenna due to compression or change of temperature by reducing the contact surface among dielectrics, thus reducing a parasitic effect.

Figure 12:
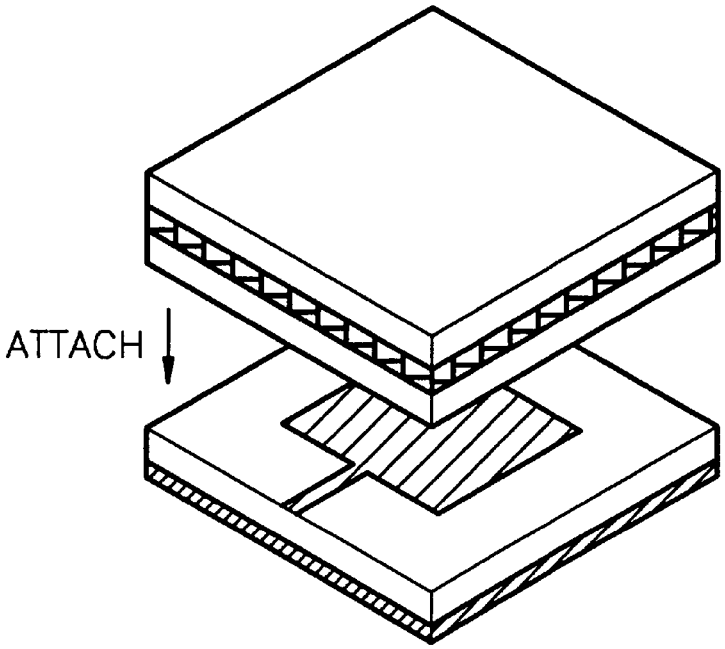
FIG. 12 shows a micro strip patch antenna using the multiple dielectric layer.
Figure 13:
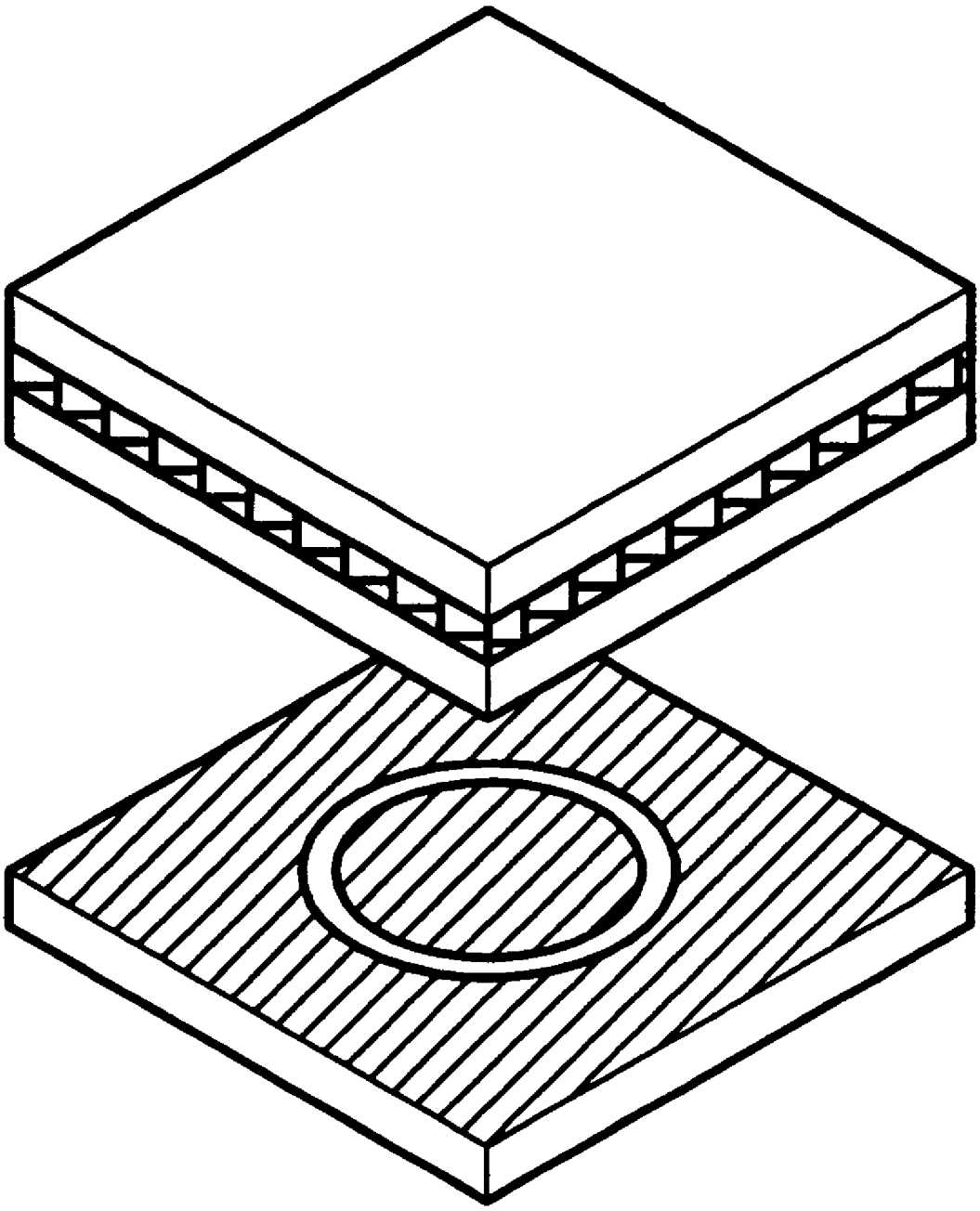
FIG. 13 shows a ring slot antenna using the multiple dielectric layer.

The multiple dielectric layer is attached to the radiation direction side of the conventional planar antenna. The radiator of the planar antenna layer can have any structure. FIG. 12 shows a micro-strip patch antenna using the multiple dielectric layer according to the present invention. FIG. 13 shows a ring slot antenna using the multiple dielectric layer according to the present invention.

Figure 14:
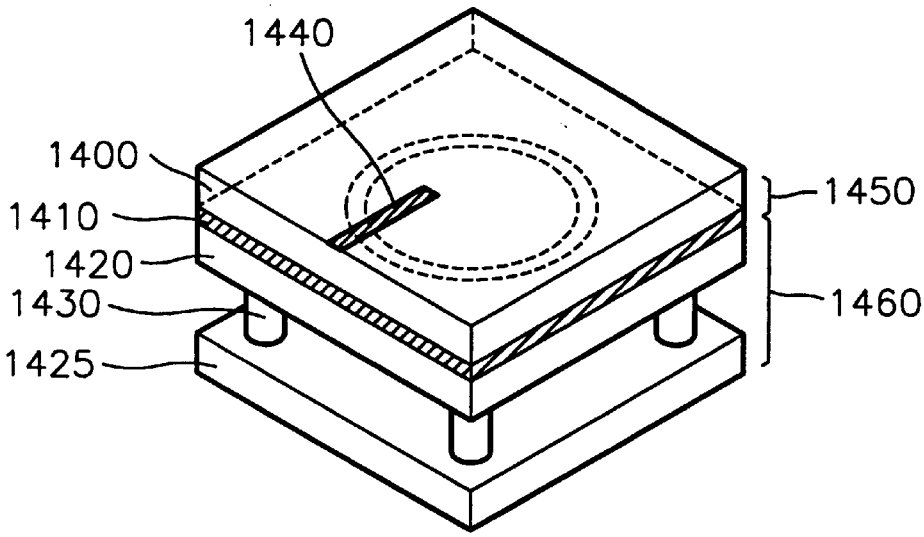
FIG. 14 shows the structure of the multiple dielectric layer according to the present invention.

FIG. 14 shows a structure of the multiple dielectric layer according to the present invention, which comprises a planar antenna 1450 and a multiple dielectric layer 1460.

The planar antenna layer 1450 is comprised of dielectric 1400 having a low dielectric constant, a conductor plate 1410 positioned under the dielectric 1400 for radiating the radio wave to the free space, and a feeder 1440 attached to the upper portion of the dielectric 1400 for feeding current for the wave radiation of the conductor plate 1410. The feeder 1440 is for the general planar antenna. The shape of the feeder 1440 may be the same as that of the feeder of the micro strip patch antenna or the ring slot antenna. The planar antenna layer 1450 induces the current to the surface of the conductor plate 1410 positioned under the dielectric 1400 or the slot shape feeder and radiates the electromagnetic wave energy to free space.

The multiple dielectric layer 1460 is comprised of an upper dielectric layer 1420 attached to the planar antenna layer 1450 and having a high dielectric constant, a lower dielectric layer 1425 formed of a dielectric having a high dielectric constant, and an air layer 1430 positioned between the upper dielectric layer 1420 and the lower dielectric layer 1425 and supported by dielectric columns. The upper dielectric layer 1420 and the lower dielectric layer 1425 are dielectric plates having the high dielectric constants and having the thickness of the ¼ wavelength (the wavelength in the dielectric). Dielectric columns having the lengths of the ¼ wavelength (the wavelength in the air) are raised in several points including the four corners of the dielectric plate. The same dielectric layer is put on each side of the columns. It is possible to realize the multiple layer dielectric having a desired number of layers by the above method. The dielectric column can be formed of the same material as the dielectric layer and a material having a low dielectric constant.

Figure 15:
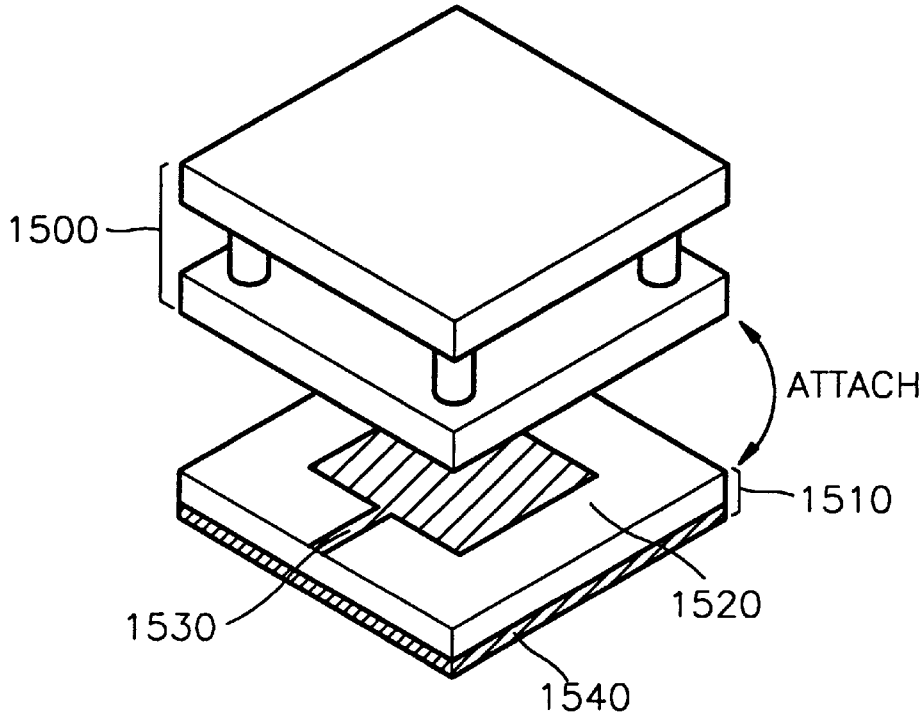
FIG. 15 shows a micro-strip patch antenna using the multiple dielectric layer into which an air layer is inserted.
Figure 16:
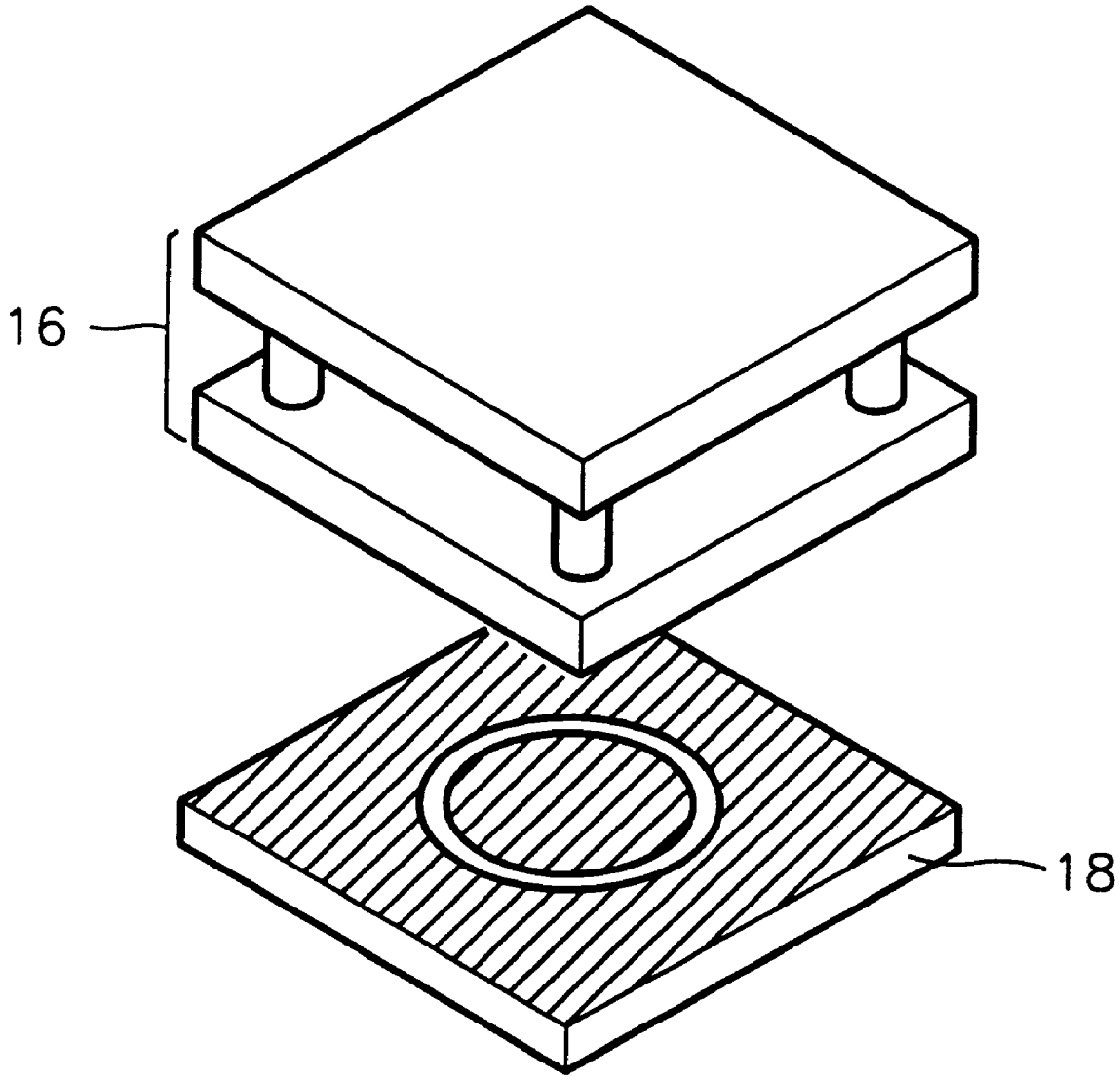
FIG. 16 shows a slot antenna using the multiple dielectric layer into which the air layer is inserted.

The multi layer dielectric is attached to the radiation direction side of the conventional planar antenna. The radiator can have any structure. FIG. 15 shows a micro-strip patch antenna using the multiple layer dielectric into which the air layer is inserted, which comprised a multiple dielectric layer according to the present invention 1500 and a micro strip patch antenna 1510. Reference numerals 1520, 1530, and 1540 respectively denote a dielectric layer, a feeder layer, and a conductor layer. FIG. 16 shows a slot antenna using the multi layer dielectric into which the air layer is inserted, which comprises the multiple dielectric layer 16 and the ring slot antenna according to the present invention 18.

The planar antenna having the ring-slot radiation device according to the present invention has a very simple structure and occupies a small space since it uses the planar structure and only one radiation device. It is possible to realize a multiple feeder circuit using the micro strip transmission line as the power supply. Since current is supplied to four places from one feeder circuit, the planar antenna can be easily connected to a monolithic microwave integrated circuit (MMIC). Therefore, this antenna can be used as the base antenna for an indoor radio communication system.

The characteristic of the bowl shaped beam suitable for the base antenna of the indoor radio communication system is obtained. In this case, since the received electromagnetic field is uniform regardless of the position of the user, the restrictions on the design of the dynamic range of the RF amplifier are relaxed. Since it is difficult to obtain a desired dynamic range in the case of the MMIC transmitter and receiver, this antenna is useful for realizing a system.

The planar antenna has the 3 dB beam width of over 120°, the symmetrical beam pattern, and maintains the characteristic of the circularly polarized wave an a wide angle over 120°. Also, the antenna occupies small space and can be easily manufactured.

Also, the antenna can be attached to the surface of devices such as a terminal, a personal digital assistant (PDA), and a notebook since it is planar. The antenna has a low manufacturing price since it can be mass-produced. Also, in the case of the millimetric wave, yield is increased since the parasitic effect is reduced when a semiconductor process is used.

Also, when the multiple layer dielectric is used, it is possible to manufacture a thick planar antenna without deteriorating the efficiency. Accordingly, the planar antenna is suitable as a the millimetric wave antenna.

It is possible to increase the efficiency and the gain of the antenna by using the multi layer dielectric in which the air layer is inserted between the dielectric layers of the planar antenna. The planar antenna can be easily manufactured even in the millimetric-wave bandwidth.

The planar antenna having the air layer using the columns can be easily manufactured since it is not necessary to join the entire surface of each dielectric. Also, the parasitic effect is reduced since the contact surface between the dielectrics is small.

Also, in the multiple layer dielectric, the gain becomes higher as the difference of dielectric constants between the respective dielectric layers is larger. Since the dielectric constant of the air layer is 1 (the minimum dielectric constant which can be obtained), the gain of the antenna is maximized and the front/back radiation ratio becomes higher.

Also, the planar antenna having the air layer using the honey comb is more efficient than the conventional planar antenna. It is possible to obtain more gain using the planar antenna according to the present invention. The planar antenna according to the present invention is stronger than the conventional planar antenna. The gain becomes higher as the difference of the dielectric constants between the respective dielectric layers of the multiple layer dielectric is increased. Since most of the honey comb area is air, the effective dielectric constant is almost 1. Therefore, the antenna gain is maximized and the front/back radiation ratio is increased.

Also, the planar antenna according to the present invention can be used for various purposes such as radio communication, radar, and a car crash prevention apparatus.

What is claimed is:

1. A planar antenna, comprising:

a conductor plate including a ring slot for radiating radio waves to free space;

an upper dielectric layer attached to the upper side of the conductor plate;

a feeder unit attached to the upper surface of the upper dielectric layer includes four micro-strip transmission lines for feeding current for the wave radiation of the conductor plate; and a lower dielectric layer including a plurality of dielectric sub-layers attached to the lower side of the conductor plate and including at least one air sub-layer whereby said radiated radio waves have a bowl-shaped, circular polarization beam characteristic.

2. The planar antenna of claim 1, wherein the lower dielectric layer has an average higher dielectric constant than the upper dielectric layer.

3. The planar antenna of claim 2, wherein the air layer has a dielectric constant equal to or less than that of the upper and lower dielectric layers of the air layer.

4. The planar antenna of claim 1, wherein the air layer has a dielectric constant equal to or less than that of the upper and lower dielectric layers of the air layer.

5. The planar antenna of claim 1, wherein the thickness of the air sub-layer is ¼ of the wavelength of the radio wave passing through the air sub-layer and wherein the thickness of the two dielectric sub-layers into which the air sub-layer is inserted is ¼ of the wavelength in the two dielectric sub-layers.

6. A planar antenna, comprising:

a conductor plate for radiating radio waves to free space;

an upper dielectric layer attached to the upper side of the conductor plate;

a feeder unit attached to the upper surface of the upper dielectric layer for feeding current for the wave radiation of the conductor plate; and a lower dielectric layer including a plurality of dielectric sub-layers attached to the lower side of the conductor plate and including at least one air sub-layer, wherein the thickness of the air sub-layer is ¼ of the wavelength of the radio wave passing through the air sub-layer and wherein the thickness of the two dielectric sub-layers into which the air sub-layer is inserted is ¼ of the wavelength in the two dielectric sub-layers.

7. The planar antenna of claim 6, wherein the air sub-layer is formed by inserting a honeycomb layer between said two dielectric sub-layers.

8. The planar antenna of claim 6, wherein the air sub-layer is formed by inserting columns between said two dielectric sub-layers.

9. A planar antenna, comprising:

a conductor plate including a ring-slot radiation device in the conductor for radiating radio waves through the ring-slot radiation device;

an upper dielectric layer attached to the upper side of the conductor plate and formed of dielectric;

a feeder unit attached to the upper surface of the upper dielectric layer for feeding current for the wave radiation of the conductor plate; and a lower dielectric layer attached to the lower side of the conductor plate and formed of dielectric, wherein the feeder unit has four micro-strip transmission lines for feeding current, wherein the four feeding points are positioned at 0°, 45°, 180°, and 225° on the basis of the central line of the ring-slot radiation device, and wherein the phases of the feeder signal fed through the respective micro strip lines are set to 0°, 90°, 0°, 90° by controlling the lengths of the micro-strip lines.

10. The planar antenna of claim 9, wherein the lower dielectric layer has a dielectric constant higher than that of the upper dielectric layer.

11. The planar antenna of claim 9, wherein the lower dielectric layer is comprised of a plurality of dielectric sub-layers.

12. The planar antenna of claim 11, wherein the plurality of dielectric sub-layers include a honeycomb layer.

13. The planar antenna of claim 11, wherein the lower dielectric layer is formed to have a thickness of $$\frac{\lambda_d}{4}$$

($\lambda_d$: the wavelength of the radio wave radiated, passing through dielectric) and is formed so that the difference between dielectric constants of adjacent dielectric layers is larger than a predetermined value.

14. The planar antenna of claim 9, wherein the lower dielectric layer is a dielectric lens.

15. The planar antenna of claim 9, wherein the circumference of the ring-slot radiation device of the conductor plate is defined to form a resonance mode of at least second degree.

16. A planar antenna, comprising:

a conductor plate including a ring-slot radiation device in the conductor for radiating radio waves through the ring-slot radiation device;

an upper dielectric layer attached to the upper side of the conductor plate and formed of dielectric;

a feeder unit attached to the upper surface of the upper dielectric layer for feeding current for the wave radiation of the conductor plate; and a lower dielectric layer attached to the lower side of the conductor plate and formed of dielectric, wherein the feeder unit has four micro-strip transmission lines for feeding current, wherein the four feeding points are positioned at 0°, 45°, 180°, and 225° on the basis of the central line of the ring-slot radiation device, wherein the positions of the four feeding points of the micro strip transmission line feeder unit are positioned at 0°, −45°, 180°, and 135° on the basis of the central line of the ring-slot radiation device, and wherein the phases of the feeder signal fed through the respective micro strip lines are set to 0°, 90°, 0°, 90° by controlling the lengths of the micro-strip lines.

17. A planar antenna, comprising:

a conductor plate including a ring-slot radiation device in the conductor for radiating radio waves through the ring-slot radiation device;

an upper dielectric layer attached to the upper side of the conductor plate and formed of dielectric;

a feeder unit attached to the upper surface of the upper dielectric layer for feeding current for the wave radiation of the conductor plate; and a lower dielectric layer attached to the lower side of the conductor plate and includes a plurality dielectric layers including an air layer;

wherein the feeder unit has four micro-strip transmission lines for feeding current, wherein the four feeding points are positioned at 0°, 45°, 180°, and 225° on the basis of the central line of the ring-slot radiation device, and wherein the phases of the feeder signal fed through the respective micro strip lines are 0°, 90°, 0°, and 90° by controlling the lengths of the micro strip lines.

* * * * *